US011037718B2

(12) United States Patent
Ryu

(10) Patent No.: US 11,037,718 B2
(45) Date of Patent: Jun. 15, 2021

(54) COIL COMPONENT

(71) Applicant: SAMSUNG ELECTRO-MECHANICS CO., LTD., Suwon-Si (KR)

(72) Inventor: Joung Gul Ryu, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 326 days.

(21) Appl. No.: 15/986,255

(22) Filed: May 22, 2018

(65) Prior Publication Data

US 2019/0180914 A1 Jun. 13, 2019

(30) Foreign Application Priority Data

Dec. 7, 2017 (KR) ..... 10-2017-0167532

(51) Int. Cl.

| | |
|---|---|
| ***H01F 27/29*** | (2006.01) |
| ***H01F 27/28*** | (2006.01) |
| ***H01F 27/24*** | (2006.01) |
| ***H01F 41/04*** | (2006.01) |
| ***H01F 41/12*** | (2006.01) |
| ***H01F 27/32*** | (2006.01) |

(Continued)

(52) U.S. Cl.

CPC ..... *H01F 27/2804* (2013.01); *H01F 17/0013* (2013.01); *H01F 17/04* (2013.01); *H01F 27/24* (2013.01); *H01F 27/29* (2013.01); *H01F 27/292* (2013.01); *H01F 27/324* (2013.01); *H01F 27/327* (2013.01); *H01F 41/042* (2013.01); *H01F 41/127* (2013.01); *H01F 2017/048* (2013.01); *H01F 2027/2809* (2013.01)

(58) Field of Classification Search

USPC ..... 336/192, 200, 232

See application file for complete search history.

(56) References Cited

U.S. PATENT DOCUMENTS

2005/0024176 A1* 2/2005 Wang ..... H01L 23/5227 336/200

2013/0038417 A1* 2/2013 Kim ..... H01F 17/0013 336/192

(Continued)

FOREIGN PATENT DOCUMENTS

JP S61-124117 A 6/1986

JP 2004-111597 A 4/2004

(Continued)

OTHER PUBLICATIONS

Office Action issued in corresponding Japanese Patent Application No. 2018-098321 dated Oct. 9, 2018.

(Continued)

*Primary Examiner* — Shawki S Ismail

*Assistant Examiner* — Kazi S Hossain

(74) *Attorney, Agent, or Firm* — Morgan, Lewis & Bockius LLP

(57) ABSTRACT

A coil component includes a body and external electrodes disposed on an external surface of the body. The body includes a support member including a through hole and a via hole, a coil including embedded coil patterns embedded in the support member and conductor layer disposed on the embedded coil patterns, and a magnetic material encapsulating the support member and the coil.

20 Claims, 9 Drawing Sheets

(51) Int. Cl.
*H01F 17/04* (2006.01)
*H01F 17/00* (2006.01)

(56) References Cited

U.S. PATENT DOCUMENTS

| | | | | |
|---|---|---|---|---|
| 2016/0005527 | A1 | 1/2016 | Park et al. | |
| 2017/0032882 | A1 | 2/2017 | Yang et al. | |
| 2017/0330674 | A1 | 11/2017 | Lee et al. | |
| 2017/0372832 | A1* | 12/2017 | Choi | H01F 41/042 |
| 2018/0366246 | A1 | 12/2018 | Park et al. | |

FOREIGN PATENT DOCUMENTS

| | | | | |
|---|---|---|---|---|
| JP | 2006-332147 | A | | 12/2006 |
| JP | 02009152347 | A | * | 12/2007 |
| JP | 2009-010268 | A | | 1/2009 |
| JP | 2017-204629 | A | | 11/2017 |
| KR | 10-1995-0003861 | A | | 7/1994 |
| KR | 10-1999-0066108 | A | | 8/1999 |
| KR | 10-2013-0135298 | A | | 12/2013 |
| KR | 10-2017-0014957 | A | | 2/2017 |
| KR | 10-2017-0060577 | A | | 6/2017 |
| KR | 10-2017-0107270 | A | | 9/2017 |
| WO | 2012093133 | A1 | | 7/2012 |

OTHER PUBLICATIONS

Korean Office Action dated Feb. 8, 2019 issued in Korean Patent Application No. 10-2017-0167532 (with English translation).

* cited by examiner

COIL COMPONENT

CROSS-REFERENCE TO RELATED APPLICATION(S)

This application claims benefit of priority to Korean Patent Application No. 10-2017-0167532 filed on Dec. 7, 2017 in the Korean Intellectual Property Office, the disclosure of which is incorporated herein by reference in its entirety.

TECHNICAL FIELD

The present disclosure relates to a coil component and more particularly, to a thin-film type power inductor including a support member.

BACKGROUND

In accordance with the development of information technology (IT), apparatuses have been rapidly miniaturized and thinned. Therefore, a demand of a market for a small thin device has increased.

Korean Patent Laid-Open Publication No. 10-1999-0066108 provides a power inductor including a substrate having a via hole and coils disposed on opposite surfaces of the substrate and electrically connected to each other through the via hole of the substrate in accordance with such a technical trend to make an effort to provide an inductor including coils having uniform and high aspect ratios. However, there is still a limitation in forming the coils having the uniform and high aspect ratios due to a limitation in a manufacturing process.

SUMMARY

An aspect of the present disclosure may provide a coil component capable of decreasing an alignment mismatch problem between a plating layer and a seed layer in a coil pattern with a fine line width at the time of forming a coil pattern having a high aspect ratio using an anisotropic plating method.

According to an aspect of the present disclosure, a coil component may include: a body including a support member, a coil formed on the support member and including a plurality of coil patterns, and a magnetic material encapsulating the support member and the coil; and external electrodes disposed on an external surface of the body and electrically connected to the coil. The support member may include a plurality of groove portions recessed toward a central portion of the support member. The groove portions may be filled with an embedded coil pattern of the coil. A conductor layer of the coil may be stacked on the embedded coil pattern.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Hereinafter, a coil component according to an exemplary embodiment in the present disclosure will be described, but is not necessarily limited thereto.

First Exemplary Embodiment

Figure 1:
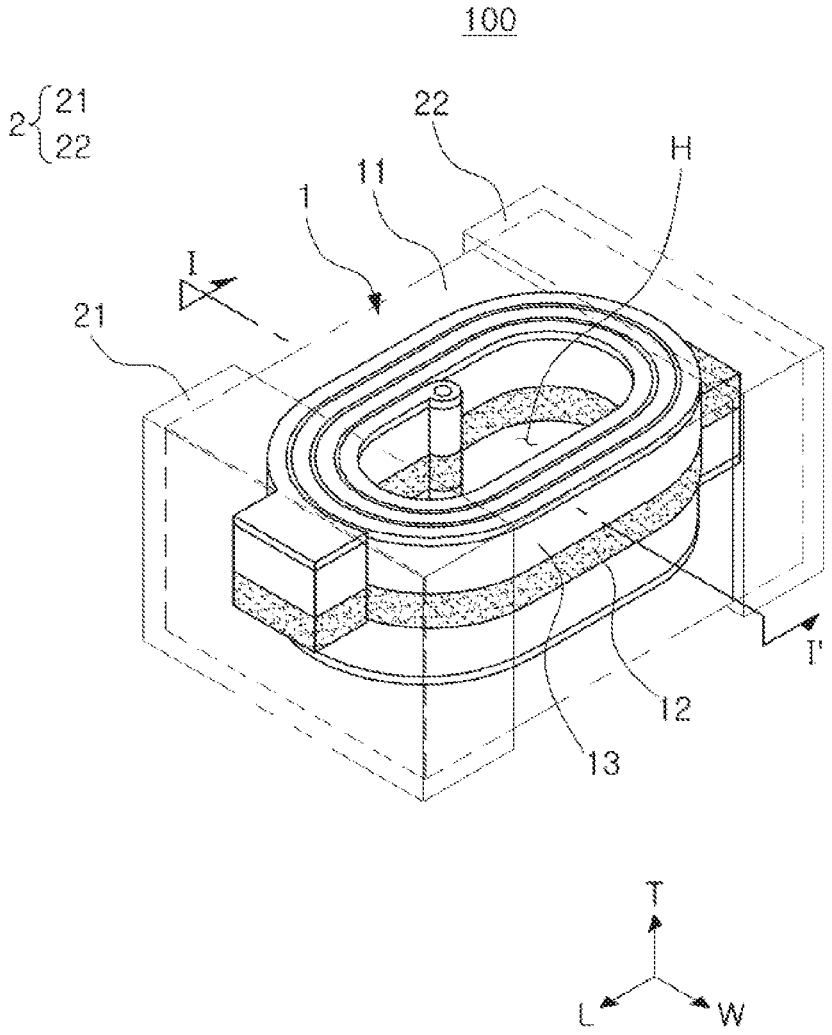
FIG. 1 is a schematic perspective view of an inductor according to a first exemplary embodiment in the present disclosure.
Figure 2:
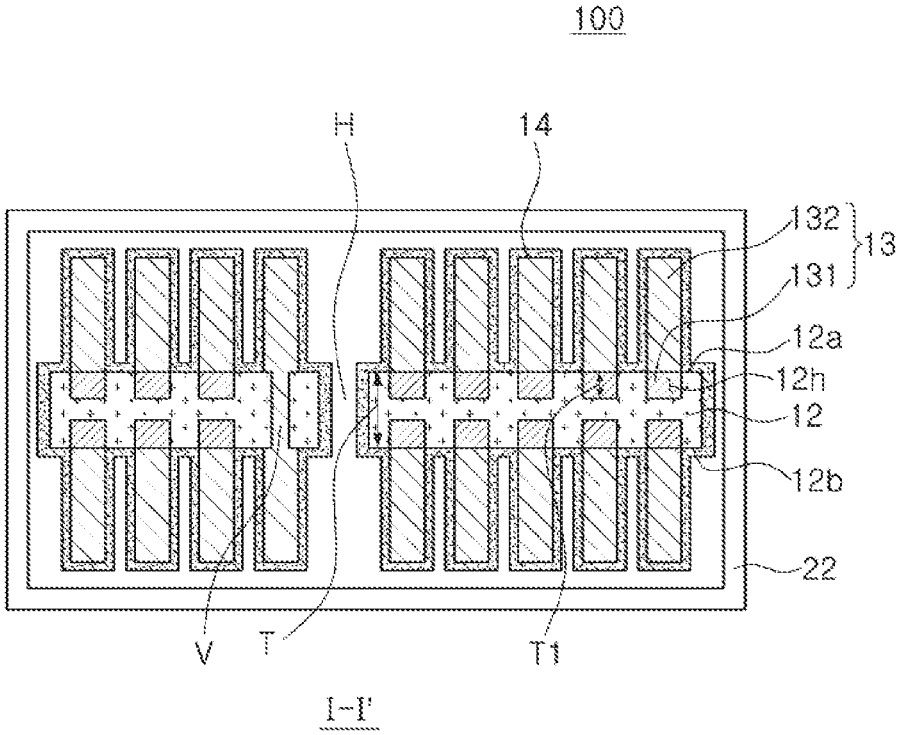
FIG. 2 is a cross-sectional view taken along line I-I' of FIG. 1.

FIG. 1 is a perspective view of a coil component 100 according to a first exemplary embodiment in the present disclosure, and FIG. 2 is a cross-sectional view taken along line I-I' of FIG. 1.

Referring to FIGS. 1 and 2, an inductor 100 may include a body 1 and external electrodes 2 disposed on an external surface of the body 1. The external electrodes 2 may include first and second external electrodes 21 and 22 facing each other and having different polarities from each other.

The body 1 may substantially form an exterior of the inductor 100, have upper and lower surfaces opposing each other in a thickness (T) direction, first and second end surfaces opposing each other in a length (L) direction, and first and second side surfaces opposing each other in a width (W) direction, and have a substantially hexahedral shape.

The body 1 may contain a magnetic material 11. As the magnetic material 11, any material may be used as long as it has magnetic properties. For example, the magnetic material 11 may be ferrite or a material in which metal magnetic particles are filled in a resin. The metal magnetic particle may contain one or more selected from the group consisting of iron (Fe), silicon (Si), chromium (Cr), aluminum (Al), and nickel (Ni).

The magnetic material 11 may serve as an encapsulant encapsulating a support member 12 to be described below and a coil 13 supported by the support member 12. Coil patterns disposed on opposite sides of the support member 12 may be electrically connected to each other through a via hole V in the support member 12. For example, a conductor layer 132 of the coil 13 to be described later may fill the via hole V. The support member 12 may have a through hole H filled with the magnetic material 11.

The support member 12 may serve to support the coil 13 and to allow the coil 13 to be more easily formed. The support member 12 may be suitably selected by those skilled in the art as long as it contains a material having suitable rigidity in order to support the coil 13 and insulation properties, and the support member 12 may have a thin plate shape. The support member 12 may mean, for example, a central core of a copper clad laminate (CCL) known in the art. Alternatively, a photo imageable dielectric (PID) resin, an ajinomoto build-up film (ABF), or the like, may also be used as the support member 12. The support member 12 may also have a structure in which prepreg, glass fiber, or the like is impregnated in a thin plate type insulating resin.

The support member 12 may have a plurality of groove portions 12*h* formed in one surface 12*a* and the other surface 12*b* of the support member 12 opposing each other. An embedded coil pattern 131 may be filled in the groove portion 12*h*. The embedded coil pattern 131, which is a portion of the coil 13 supported by the support member 12, may substantially serve as a seed layer of the coil 13. A cross-sectional shape of the embedded coil pattern 131 is not particularly limited, but in consideration of convenience of a process, the cross-sectional shape of the embedded coil pattern 131 may be a tetragon. A depth T1 of the groove portion 12*h* may be less than ⅓ of an entire thickness T of the support member. When the depth of the groove portion 12*h* is greater than ⅓ of the entire thickness of the support member 12, the support member 12 may not maintain rigidity enough to support the coil 13, or a defect that the groove portions 12*h* on one surface and the other surface of the support member 12 penetrate through each other may occur.

The conductor layer 132 of the coil 13 may be disposed on the embedded coil pattern 131. The conductor layer 132 may be a plating layer growing on the embedded coil pattern 131 serving as the seed layer. A cross section of the conductor layer 132 may be a tetragon similarly to the cross section of the embedded coil pattern 131. However, unlike the embedding coil pattern 131 having a thickness of about 20 μm or so, the conductor layer 132 may have a thickness of 150 μm to 200 μm, such that the conductor layer 132 may substantially determine an aspect ratio of the coil pattern.

Materials of the embedded coil pattern 131 and the conductor layer 132 are not particularly limited as long as they have excellent electrical conductivity, and these material may be different from each other, but when the embedded coil pattern 131 and the conductor layer 132 are formed of the same material as each other, adhesion between the embedded coil pattern 131 and the conductor layer 132 may be improved. For example, the embedded coil pattern 131 and the conductor layer 132 may be formed of the same kind of Cu alloy.

The conductor layer 132 may become fine so as to have a line width of about 30 μm or so. In this case, it may be easy to match alignment between the seed layer and the conductor layer as compared to a case in which a conductor layer is formed based on a general seed layer instead of the embedded coil pattern. For example, in a case in which a seed layer is embedded in a support member in advance to configure an embedded coil pattern, when an opening portion is formed through exposure and development after laminating an insulator on the support member, even though the remaining insulator is at least partially disposed on the embedded coil pattern, an alignment defect of the coil pattern does not occur. However, in a case which the seed layer protrudes, a position at which the remaining insulator may be disposed without the alignment defect of the coil pattern may be more restrictive.

The coil pattern including the embedded coil pattern 131 and the conductor layer 132 may be enclosed by an insulating layer 14, such that adjacent coil patterns may be insulated from each other, and the coil pattern 13 and the magnetic material 11 may be insulated from each other by the insulating layer 14. A thickness of the insulating layer 14 is not particularly limited, but may be about 1 μm or more to 10 μm or less. When the thickness of the insulating layer 14 is less than 1 μm, insulation reliability may not sufficiently secured, and when the thickness of the insulating layer 14 is more than 10 μm, a space to be filled with the magnetic material may be restricted.

Even though the conductor layer has a high aspect ratio, adjacent conductor layers may have the same thickness as each other and each of the conductor layers may have a substantially rectangular cross-sectional shape, which are characteristics derived from a manufacturing process of an inductor to be described below. However, a manufacturing process of an inductor to be described below is provided by way of example, and may be suitably changed by those skilled in the art. Alternatively, a different manufacturing process may be selected by those skilled in the art.

Figure 3A:
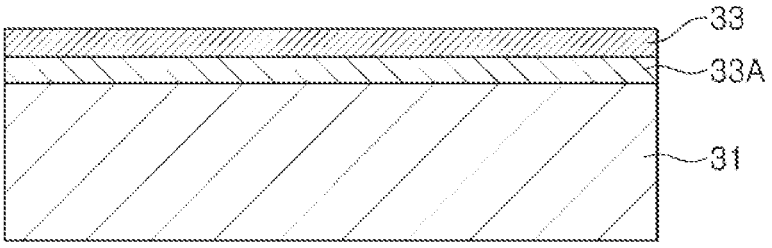
FIGS. 3A through 3I illustrate an example of a method of manufacturing the inductor of FIGS. 1 and 2.
Figure 3B:
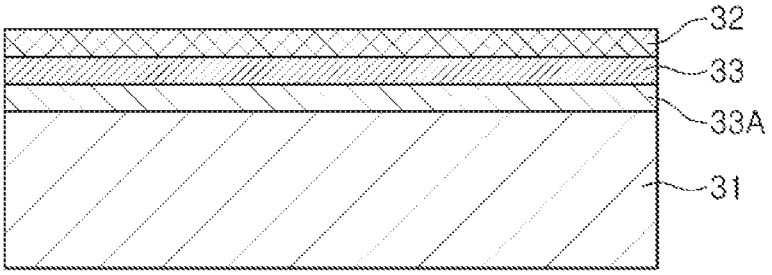
Figure 3C:
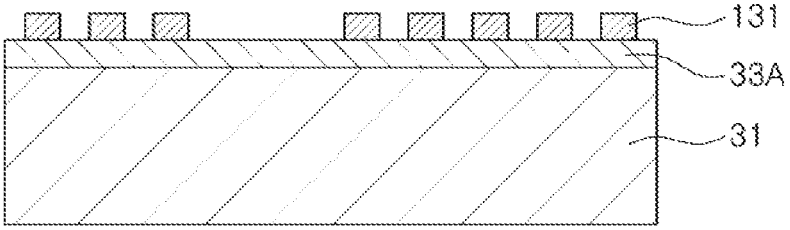
Figure 3D:
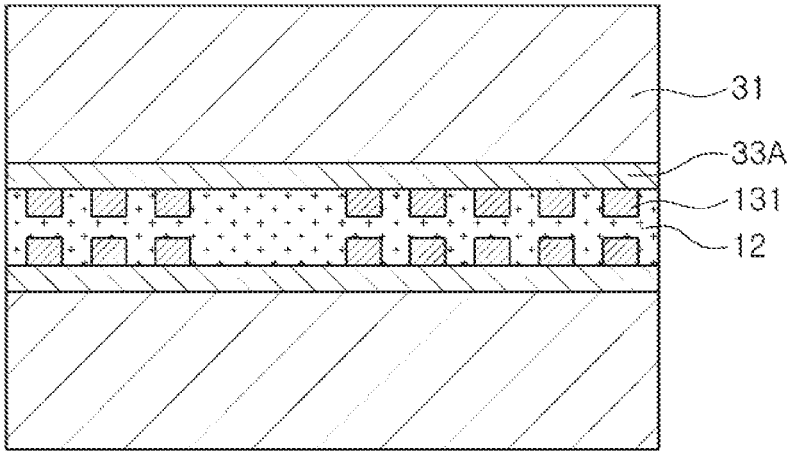
Figure 3E:
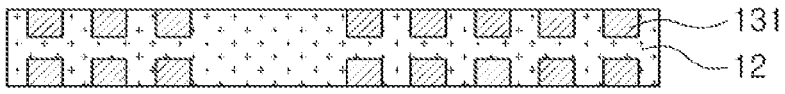
Figure 3F:
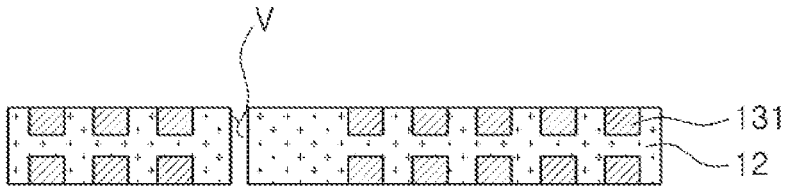
Figure 3G:
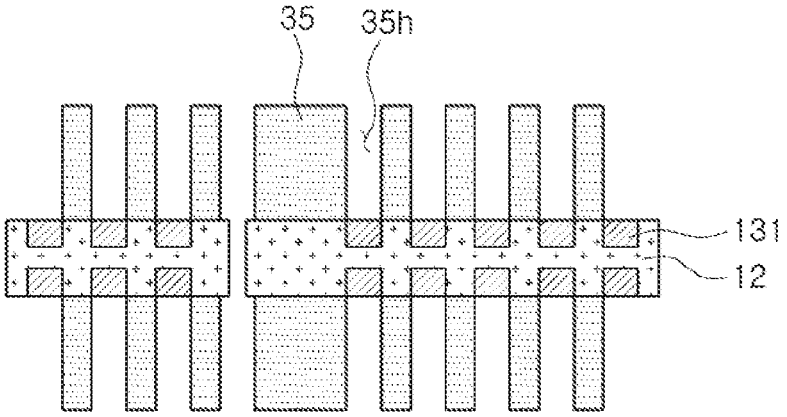
Figure 3H:
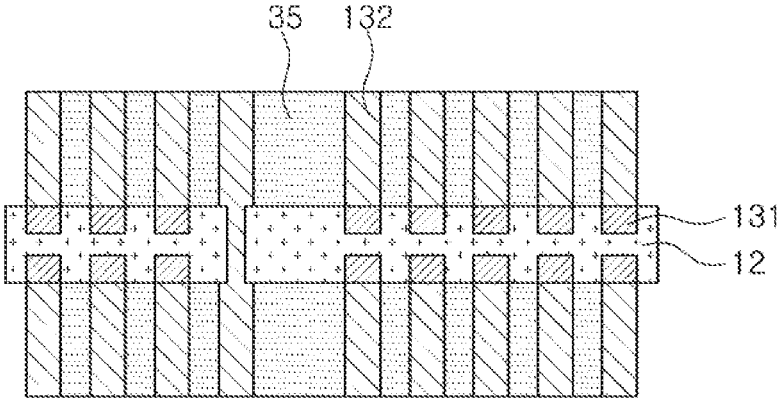
Figure 3I:
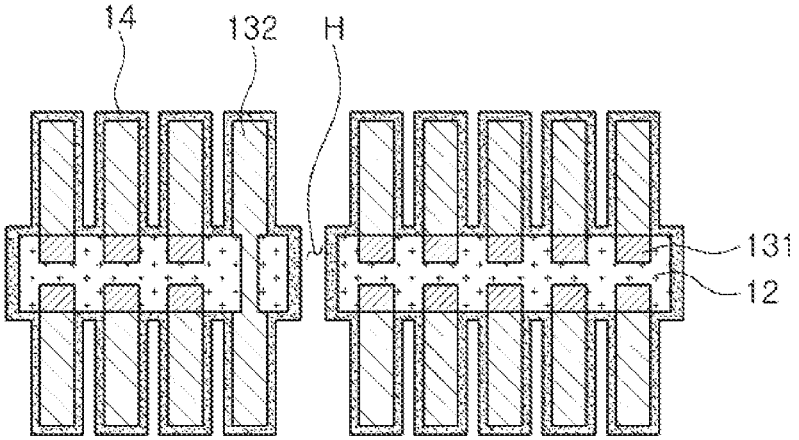

FIGS. 3A through 3I illustrate a manufacturing process of the inductor 100 according to the first exemplary embodiment. First, as illustrated in FIG. 3A, a carrier substrate 31 including a conductive film 33 may be prepared. A releasing film 33A may be disposed between the conductive films 33 and the carrier substrate 31. Next, as in FIG. 3B, a dry film resist (DFR) film 32 may be stacked on the carrier substrate 31. As illustrated in FIG. 3C, the DFR film 32 may be patterned by exposure and development, and then, using the patterned DFR film 32 as an etching mask, a seed layer 33 may be formed by etching the conductive film 33. Thereafter, the DFR film 32 may be removed. Then, repeating the processes shown in FIGS. 3A-3C to form another structure similar to that shown in FIG. 3C. As illustrated in FIG. 3D, the two seed layers 33 of the two prepared structures may be disposed to face each other with an insulating material 34 interposed therebetween by a V-press. Then, as illustrated in FIG. 3E, a support member 12 including these two seed layers 131 may be separated from the carrier substrates 31 and the releasing films 33A. Next, as illustrated in FIG. 3F, a via hole V may be formed by processing the via hole, and as illustrated in FIG. 3G, insulators 35 may be laminated on upper and lower surfaces of the support member 12, respectively, and patterned by exposure and development so as to have opening portions 35*h*. Here, the seed layer 131 embedded in the support member 12 needs to be at least partially exposed by the opening portions 35*h*. As illustrated in FIG. 3H, a conductive material may be filled in the opening portions 35*h* to form a conductor layer 132. Here, a thickness of the insulator 35 may be substantially equal to or thicker than that of the conductor layer 132. As illustrated in FIG. 3I, the insulator 35 may be removed, and an insulating layer 14 may be disposed on a surface of the conductor layer 132 exposed by removing the insulator 35. In this case, an insulating resin may be coated by a chemical vapor deposition method or an insulating sheet may be laminated, in order to form the insulating layer 14. Further, a cavity process for forming a through hole H may be simultaneously performed at the time of removing the insulator 35. Next, although not specifically illustrated, a coil component may be completed through a general finishing method.

Except for the description described above, a description of features overlapping those of the above-mentioned coil component according to the first embodiment in the present disclosure will be omitted.

Second Exemplary Embodiment

Figure 4:
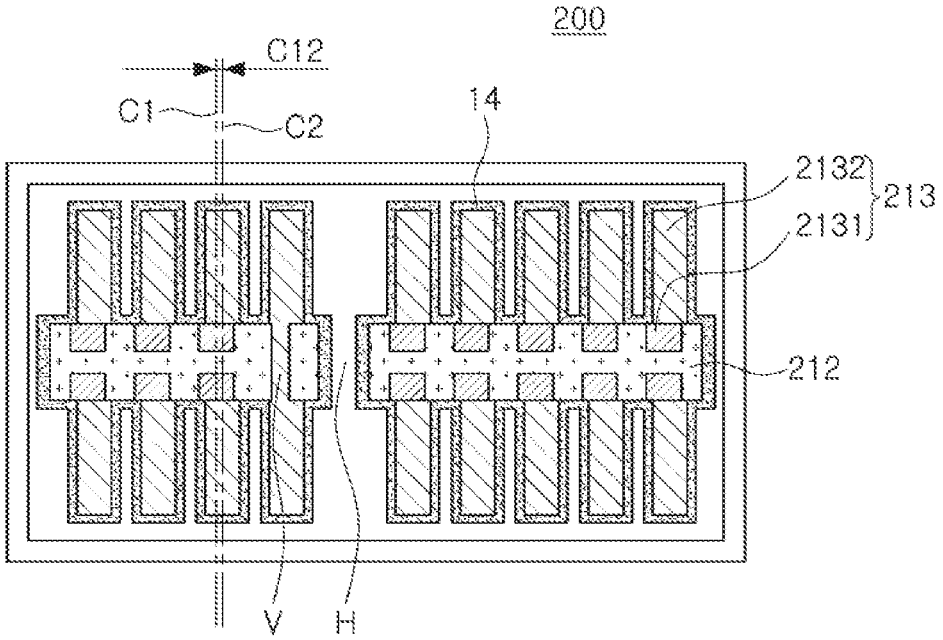
FIG. 4 is a cross-sectional view of an inductor according to a second exemplary embodiment in the present disclosure.

Next, FIG. 4 is a cross-sectional view of a coil component 200 according to a second exemplary embodiment in the present disclosure. The coil component 200 according to the second exemplary embodiment is different from the coil component 100 according to the first exemplary embodiment in that a central line C1 of a line width of an embedded coil pattern does not coincide with a central line C2 of a line width of a plating layer formed thereon. For convenience of explanation, a description of configurations overlapping those of the coil component 100 according to the first exemplary embodiment described above will be omitted, and a difference therebetween will be mainly described.

Referring to FIG. 4, a coil 213 of the coil component 200 may include an embedded coil pattern 2131 embedded in a support member 212 and a conductor layer 2132. The central line of the line width of the embedded coil pattern 2131 may be spaced apart from the central line of the line width of the conductor layer 2132 by a predetermined interval. This corresponds to a case in which alignment of the embedded coil pattern 2131 with respect to a reference pattern and alignment of the conductor layer 2132 with respect to the reference pattern do not coincide with each other. Generally, when alignments of respective coil layers do not coincide with each other, a disconnection problem such as an open failure, or the like, may easily occur, but in the coil component 200, even though the alignments of respective coil layers do not coincide with each other, since the embedded coil pattern 2131 serving as a seed layer is in a state in which the embedded coil pattern 2131 is stably embedded in the support member 212, occurrence of the disconnection problem such as the open failure, or the like, may be significantly decreased as long as at least a portion of an upper surface of the embedded coil pattern 2131 and at least a portion of a lower surface of the conductor layer 2132 come in contact with each other.

In this case, a spaced interval C12 between the central line of the line width of the embedded coil pattern 2131 and the central line of the line width of the conductor layer 2132 may be adjusted by those skilled in the art within a suitable error range.

Third Exemplary Embodiment

Figure 5:
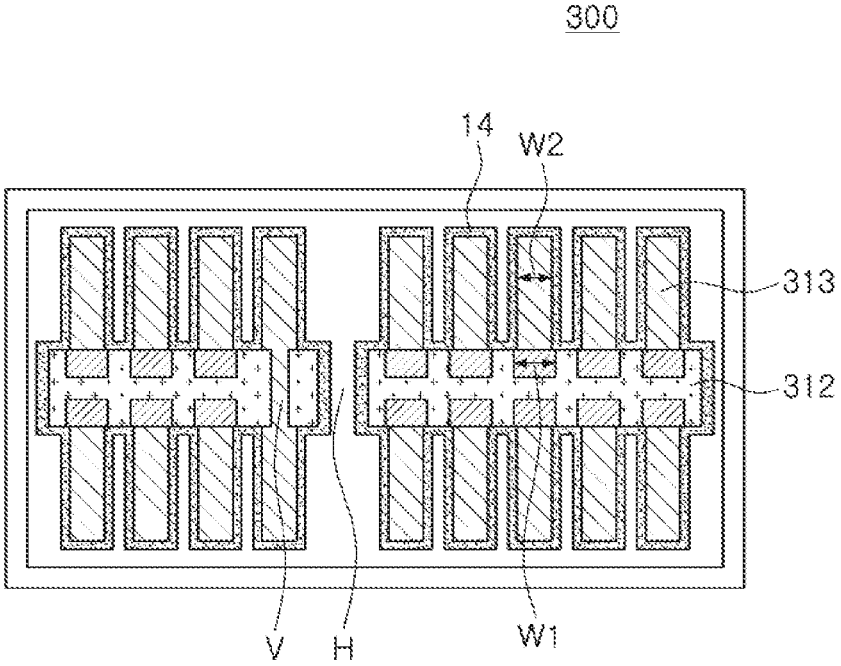
FIG. 5 is a cross-sectional view of an inductor according to a third exemplary embodiment in the present disclosure.

FIG. 5 is a cross-sectional view of a coil component 300 according to a third exemplary embodiment. In the coil component 300 according to the third exemplary embodiment, a line width W1 of an embedded coil pattern of a coil 313 embedded in a support member 312 may be greater than a line width W2 of a conductor layer of the coil disposed on the embedded coil pattern. Since the line width of the embedded coil pattern is relatively greater than that of the conductor layer, a seed layer serving as a base of the conductor layer having a fine pitch may have a wide line width, such that even though a process error occurs at the time of adjusting alignment through exposure and development of an insulator, a risk of an open failure, or the like, may be decreased. Further, when the line width of the embedded coil pattern is relatively greater than that of the conductor layer, at the time of removing the insulator using a $CO_2$ laser, the embedded coil pattern may attenuate an output of the $CO_2$ laser to prevent a support member from being damaged by the laser. As a result, a defect that the coil is delaminated from the support member, or the like, may be prevented.

Fourth Exemplary Embodiment

Figure 6:
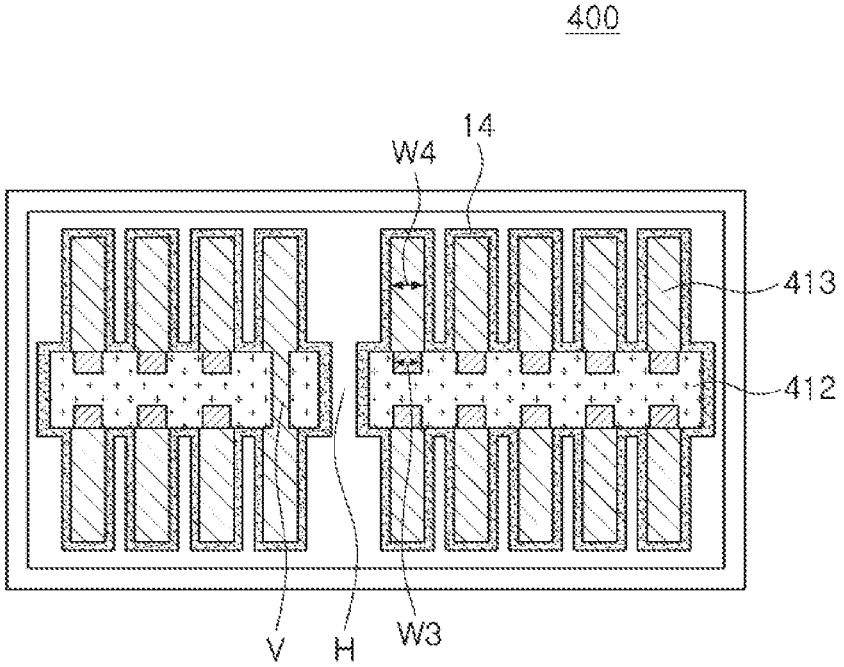
FIG. 6 is a cross-sectional view of an inductor according to a fourth exemplary embodiment in the present disclosure.

FIG. 6 is a cross-sectional view of a coil component 400 according to a fourth exemplary embodiment in the present disclosure. In the coil component 400 according to the fourth exemplary embodiment, a line width W3 of an embedded coil pattern of a coil 413 embedded in a support member 412 is smaller than a line width W4 of a conductor layer of the coil 413 disposed on the embedded coil pattern. In this case, a fine pitch of the embedded coil pattern may be implemented enough to further decrease the line width of the embedded coil pattern. As a result, this structure is advantageous for significantly increasing the entire number of turns of the coil pattern. The number of turns of the coil pattern may be increased by decreasing the line width of the embedded coil pattern, and the line width of the conductor layer disposed thereon may be relatively wide, such that this structure is advantageous for decreasing side effects such as breakage of the conductor layer at the time of increasing a thickness of the conductor layer, and the like.

Fifth Exemplary Embodiment

Figure 7:
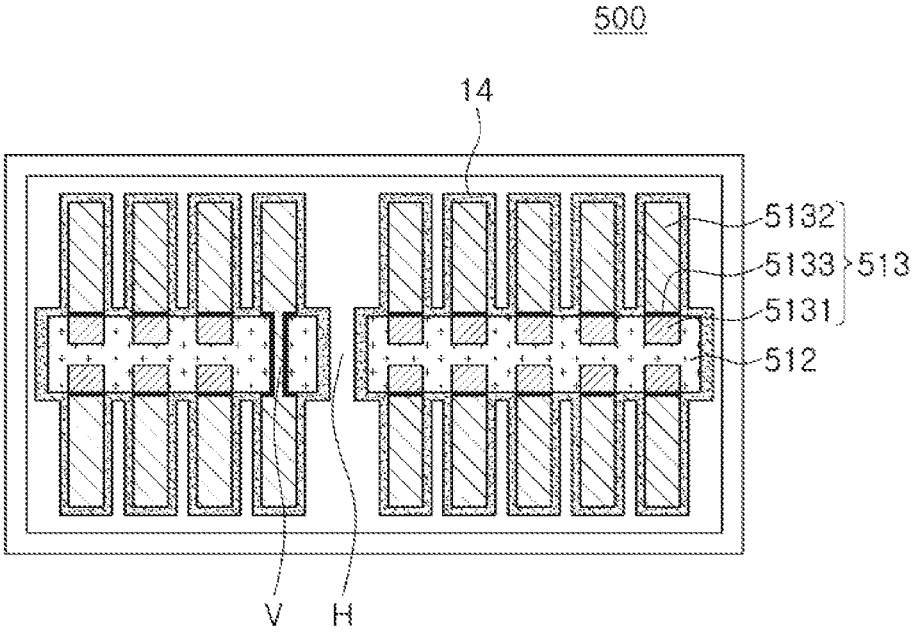
FIG. 7 is a cross-sectional view of an inductor according to a fifth exemplary embodiment in the present disclosure.

FIG. 7 is a cross-sectional view of a coil component 500 according to a fifth exemplary embodiment in the present disclosure. The coil component 500 according to the fifth exemplary embodiment may be different from the coil component 100 according to the first exemplary embodiment in that a thin film conductor layer 5133 is interposed between an embedded coil pattern 5131 and a conductor layer 5132. The thin film conductor layer 5133 may have preferably a nano-scale thickness, and more preferably, 50 nm or more to 1 μm or less. A side surface of the thin film conductor layer 5133 may directly contact with an insulating layer 14 enclosing the conductor layer 5132. A side surface of a via hole V may be enclosed by the thin film conductor layer 5133, and a center of the via hole V may be filled with the conductor layer 5132. A specific method of forming the thin film conductor layer 5133 is not limited, but it is suitable to use a metal sputtering method in order to uniformly form the thin film conductor layer 5133 having a thin thickness. As a result, since even a material which is slightly restrictively used in a chemical copper plating method, or the like, may be included in examples of a material forming the thin film conductor layer 5133, a degree of freedom in selecting the material may be relatively increased. For example, the thin film conductor layer 5133 may contain one or more of Mo, Ti, Ni, Al, and W, but is not limited thereto. The thin film conductor layer 5133 may be added before the insulator is laminated in the manufacturing method described in FIGS. 3A through 3I. The thin film conductor layer 5133 may be patterned by removing a thin film conductor layer except for a thin film conductor layer coming in contact with a lower surface of the conductor layer at the time of removing an insulator using a laser after integrally forming the thin film conductor layer on an upper surface of the embedded coil pattern 5131 prepared in advance as well as upper and lower surfaces of a support member 512 and forming all the conductor layers 5132. The thin film conductor layer 5133 may serve to increase close adhesion between the insulator and the support member in a manufacturing process of the coil component. Since in a case of patterning the insulator, an aspect of the patterned insulator is increased substantially to about 20 or so, a leaning defect or delamination phenomenon of the patterned insulator may occur. Therefore, a risk of delamination of the insulator or occurrence of a short-circuit due to delamination may be removed by forming the thin film conductor layer in advance before laminating the insulator to increase close adhesion between the insulator and the support member. Further, since a $CO_2$ laser does not pass through the insulator to thereby be directly irradiated to the support member, but arrives earlier at the thin film conductor layer, output of the $CO_2$ laser may be attenuated, such that damage of the support member may be prevented.

Sixth Exemplary Embodiment

Figure 8:
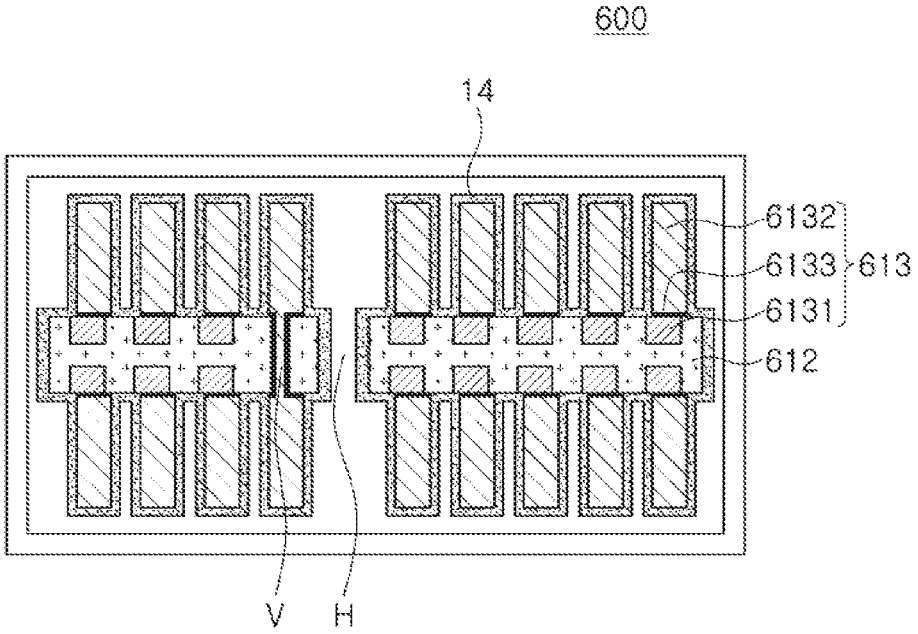
FIG. 8 is a cross-sectional view of an inductor according to a sixth exemplary embodiment in the present disclosure.

FIG. 8 is a cross-sectional view of a coil component 600 according to a sixth exemplary embodiment in the present disclosure. The coil component 600 according to the sixth exemplary embodiment may be different from the coil component 200 according to the second exemplary embodiment in that a thin film conductor layer 6133 is interposed between an embedded coil pattern 6131 embedded in a support member 612 and a conductor layer 6132. A description of the coil component 200 according to the second exemplary embodiment may be applied to the coil component 600 as it is, and a description of an effect exhibited by interposing the thin film conductor layer, for example, an effect of preventing delamination of an insulator, or the like, may be applied to the coil component 600 as it is. Since close adhesion between the thin film conductor layer and the insulator is excellent, at the time of removing the insulator using a laser, the thin film conductor layer adhered below the insulator may also be easily removed together.

Seventh Exemplary Embodiment

Figure 9:
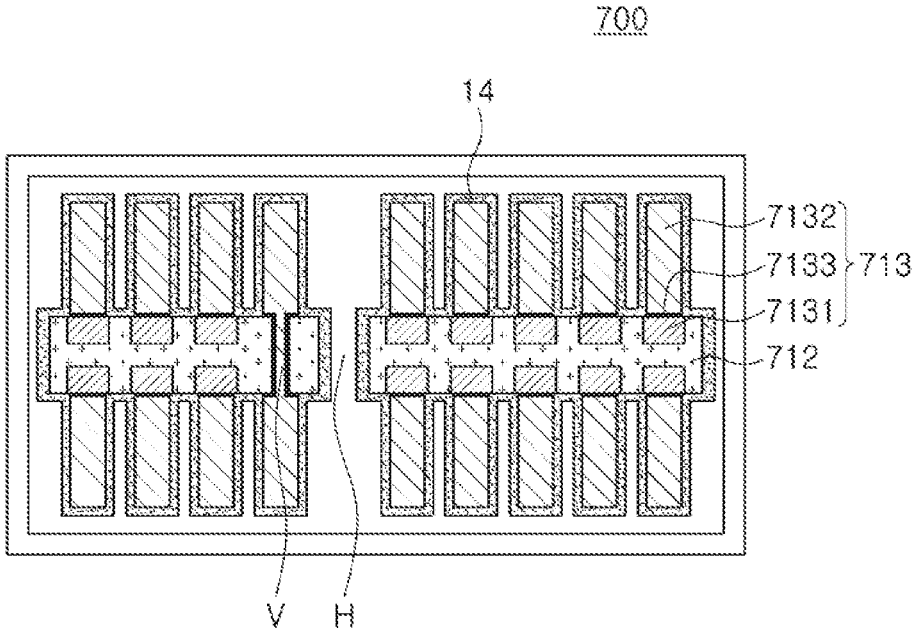
FIG. 9 is a cross-sectional view of an inductor according to a seventh exemplary embodiment in the present disclosure.

FIG. 9 is a cross-sectional view of a coil component 700 according to a seventh exemplary embodiment in the present disclosure. The coil component 700 according to the seventh exemplary embodiment is different from the coil component 300 according to the third exemplary embodiment in that a thin film conductor layer 7133 is interposed between an embedded coil pattern 7131 embedded in a support member 712 and a conductor layer 7132, but since the coil component 700 includes configurations overlapping those in the coil component 300, a detailed description thereof will be omitted.

Eighth Exemplary Embodiment

Figure 10:
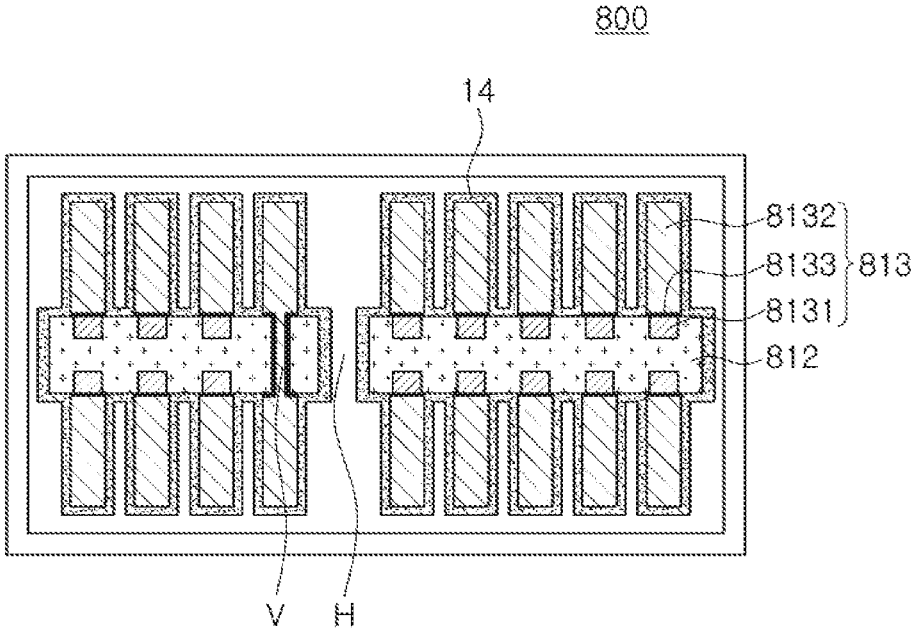
FIG. 10 is a cross-sectional view of an inductor according to an eighth exemplary embodiment in the present disclosure.

FIG. 10 is a cross-sectional view of a coil component 800 according to an eighth exemplary embodiment in the present disclosure. The coil component 800 according to the eighth exemplary embodiment is different from the coil component 400 according to the fourth exemplary embodiment in that a thin film conductor layer 8133 is interposed between an embedded coil pattern 8131 embedded in a support member 812 and a conductor layer 8132, but since the coil component 800 includes configurations overlapping those in the coil component 400, a detailed description thereof will be omitted.

With the above-mentioned coil component, a degree of freedom in alignment may be increased as compared to a seed layer protruding from one surface and the other surface of the support member by allowing the embedded coil pattern corresponding to the seed layer to be embedded from one surface and the other surface of the support member. As a result, a problem such as a short-circuit defect due to eccentricity capable of occurring in exposure and development of the insulator, a limitation in ultra-fine patterning, or the like, may be solved. Further, the embedded coil pattern, which is a portion of the coil, may be embedded from one surface and the other surface of the support member, such that a thickness of the entire coil component may be decreased at the time of implementing the same thickness of the coil, which is advantageous for providing a low-profile coil component. Further, since the aspect ratio of the coil is increased based on a coil component having the same thickness, electric properties such as Rdc, and the like, may be excellent, and as a thickness of the insulating layer is decreased by embedding the seed layer, a path of a magnetic flux may be decreased and a filling thickness of the magnetic material on and below the coil may be increased, such that a DC-bias effect may be improved due to an increase in inductance and a decrease in magnetic flux density.

As set forth above, according to exemplary embodiments in the present disclosure, the coil component of which Rdc characteristics are improved by significantly increasing the thickness of the coil pattern and allowing the coil pattern to have a fine line width within a restricted size of the coil component may be provided.

While exemplary embodiments have been shown and described above, it will be apparent to those skilled in the art that modifications and variations could be made without departing from the scope of the present invention as defined by the appended claims.

What is claimed is:

1. A coil component comprising:

a body including a support member including a through hole and a via hole, a coil formed on the support member and including a plurality of coil patterns, and a magnetic material encapsulating the support member and the coil; and external electrodes disposed on an external surface of the body and electrically connected to the coil, wherein the support member includes a plurality of groove portions recessed toward a central portion of the support member in a shape corresponding to a shape of the coil, the groove portions are filled with an embedded coil pattern of the coil, and a conductor layer of the coil is stacked on the embedded coil pattern.

2. The coil component of claim 1, wherein a depth of the groove portion is equal to or less than ⅓ of an entire thickness of the support member.

3. The coil component of claim 1, wherein a central line of the embedded coil pattern coincides with a central line of the conductor layer.

4. The coil component of claim 1, wherein a central line of the embedded coil pattern is offset from a central line of the conductor layer by a predetermined interval.

5. The coil component of claim 1, wherein a line width of the embedded coil pattern is greater than that of the conductor layer disposed thereon.

6. The coil component of claim 1, wherein a line width of the embedded coil pattern is smaller than that of the conductor layer disposed thereon.

7. The coil component of claim 1, wherein an insulating layer is disposed on a surface of the conductor layer.

8. The coil component of claim 1, wherein the through hole is filled with the magnetic material.

9. The coil component of claim 1, wherein the via hole is filled with the conductor layer.

10. The coil component of claim 1, further comprising a thin film conductor layer disposed between the embedded coil pattern and the conductor layer.

11. The coil component of claim 10, wherein the thin film conductor layer has a thickness of 50 nm or more to 1 μm or less.

12. The coil component of claim 10, wherein the thin film conductor layer contains one or more of Mo, Ti, Al, Ni, and W.

13. The coil component of claim 10, wherein a material of the thin film conductor layer is different from a material of the embedded coil pattern.

14. The coil component of claim 10, wherein a side surface of the thin film conductor layer directly contacts with an insulating layer enclosing the conductor layer.

15. The coil component of claim 10, wherein a side surface of the via hole is enclosed by the thin film conductor layer, and the center of the via hole is filled with the conductor layer.

16. The coil component of claim 1, wherein an upper or lower surface of the embedded coil pattern is coplanar with an upper or lower surface of the support member, respectively.

17. The coil component of claim 1, wherein the support member includes upper and lower surfaces opposing each other in a thickness direction, and the plurality of groove portions includes first groove portions recessed toward the central portion from the upper surface and second groove portions recessed toward the central portion from the lower surface.

18. The coil component of claim 1, wherein the support member includes upper and lower surfaces opposing each other in a thickness direction, and the conductor layer of the coil is stacked on the embedded coil pattern from or above the upper surface, or the conductor layer of the coil is stacked on the embedded coil pattern from or below the lower surface.

19. The coil component of claim 1, wherein the groove portions are completely filled with the embedded coil pattern.

20. The coil component of claim 1, wherein the support member includes upper and lower surfaces opposing each other in a thickness direction, and the conductor layer includes a first conductor layer which extends from the upper surface in a direction opposite a direction in which a second conductor layer extends from the lower surface.

* * * * *